United States Patent [19]
Price
[11] 4,260,119
[45] Apr. 7, 1981

[54] APPARATUS FOR SUPPORTING AND GUIDING A FLEXIBLE LINE

[75] Inventor: Dennis D. Price, Joliet, Ill.

[73] Assignee: Midland Metalcraft Company, Joliet, Ill.

[21] Appl. No.: 24,565

[22] Filed: Mar. 28, 1979

[51] Int. Cl.[3] ..... B65H 57/00

[52] U.S. Cl. ..... 242/157 R; 226/196; 254/389

[58] Field of Search ..... 242/157 R; 254/190 R, 254/190 C; 226/196, 197, 198, 199

[56] References Cited

U.S. PATENT DOCUMENTS

| | | | |
|---|---|---|---|
| 2,345,816 | 4/1944 | Hays | 242/157 R X |
| 2,629,768 | 2/1953 | Beil | 254/190 R X |
| 2,694,130 | 11/1954 | Howard | 226/196 X |
| 2,770,499 | 11/1956 | Rapisarda | 242/157 R X |
| 2,926,001 | 2/1960 | Mack et al. | 242/157 R X |
| 3,370,642 | 2/1968 | Meier et al. | 226/196 X |
| 3,690,560 | 9/1972 | Boyd | 239/195 |

FOREIGN PATENT DOCUMENTS

| | | | |
|---|---|---|---|
| 183273 | 4/1963 | Sweden | 254/190 R |

*Primary Examiner*—Stanley N. Gilreath
*Attorney, Agent, or Firm*—Leydig, Voit, Osann, Mayer & Holt, Ltd.

[57] ABSTRACT

A spray head is carried on the end of a flexible hose guided for up and down movement in a chute by a length of roller chain which allows the hose to curve gradually from horizontal to vertical while providing a low friction support for the hose. The chain may be inserted endwise into the chute through a relatively small hole formed in the chute and in a wall surrounding the chute.

8 Claims, 5 Drawing Figures

APPARATUS FOR SUPPORTING AND GUIDING A FLEXIBLE LINE

BACKGROUND OF THE INVENTION

This invention relates generally to apparatus for supporting and guiding a flexible line for movement along a path having a substantially straight portion and having a downwardly concave portion located at one end of the straight portion. While the apparatus of the invention can be employed in numerous applications, it is especially adapted for use with a device for sanitizing trash or laundry chutes.

A typical chute sanitizer is disclosed in Boyd U.S. Pat. No. 3,690,560 and is adapted for use with a chute which is housed in the wall of a building. Such a sanitizer includes a spray head suspended from the end of a flexible line or hose which extends outwardly through the chute and the wall adjacent the upper end of the chute. The hose is wound around a power-driven reel and communicates with a source of cleaning solution. When the reel is rotated first in one direction and then the other, the spray head is moved downwardly and upwardly within the chute and sprays the solution against the chute to clean the latter.

Typically, a pulley is mounted within the chute adjacent the upper end thereof and serves to guide and support the hose. The hose usually extends horizontally from the reel, through the wall and into the chute, curves downwardly around the pulley and then depends vertically into the chute. The pulley guides the hose to curve gradually from horizontal to vertical and serves as a low friction support for the hose.

SUMMARY OF THE INVENTION

The primary aim of the present invention is to provide new and improved line supporting and guiding apparatus which serves the same general purpose as a pulley but which can be installed much more quickly and easily in an encumbered space such as a chute where access may be limited and difficult to reach.

A related object is to provide unique line supporting and guiding apparatus which can be installed, for example, in a chute by making a relatively small hole in the chute and the wall and without need of performing any installation or mounting operations inside of the chute itself.

A more detailed object is to achieve the foregoing by providing a line supporting and guiding apparatus which uniquely utilizes a roller chain adapted to be inserted endwise through a hole in the wall and the chute and adapted thereafter to automatically curve downwardly so as to guide the line around a relatively large radius while serving as a low friction support for the line.

The invention also resides in the novel combination of a roller chain with a tube for guiding the line through a wall or the like.

These and other objects and advantages of the invention will become more apparent from the following detailed description when taken in conjunction with the accompanying drawings.

DETAILED DESCRIPTION OF THE PREFERRED EMBODIMENT

Figure 1:
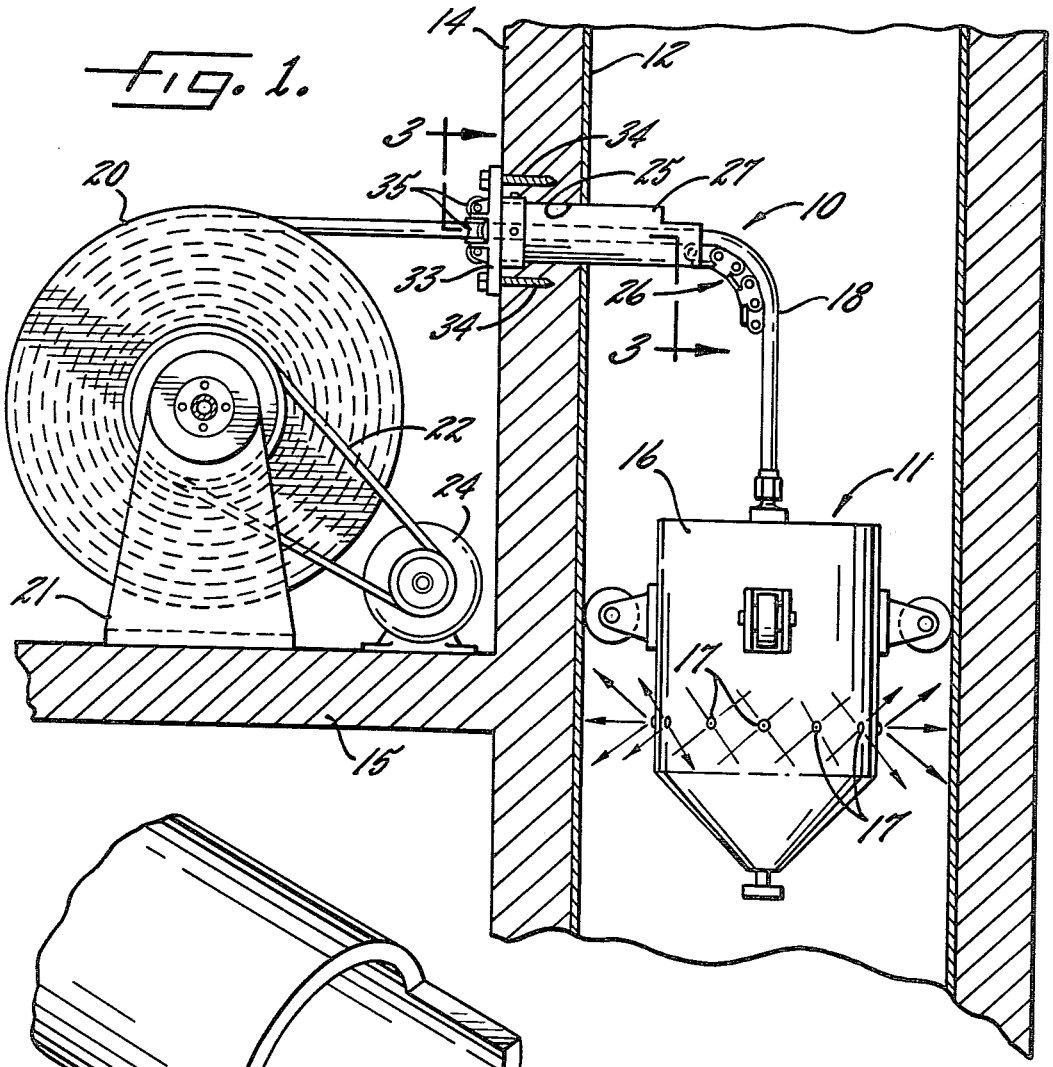
FIG. 1 is a side elevational view of a chute sanitizer equipped with new and improved line supporting and guiding apparatus incorporating the unique features of the present invention, the chute and the surrounding wall being shown in cross-section.

For purposes of illustration, the line supporting and guiding apparatus 10 of the present invention is shown in conjunction with a sanitizer 11 for cleaning a trash chute 12. The chute herein is formed by a sleeve of sheet metal installed in the wall 14 of a multi-story building and extending, in most instances, between the top floor 15 and the bottom floor (not shown) of the building. Trash deposited into the chute through doors (not shown) at various levels of the building falls to a central collection area at the bottom of the chute.

The chute sanitizer 11 may be of the same general type as disclosed in the aforementioned Boyd patent to which reference may be had for details of construction and operation. Briefly, the sanitizer includes a spray head 16 adapted to periodically travel downwardly and upwardly within the chute 12 and having a series of angularly spaced nozzles 17 for spraying jets of cleaning and sanitizing solution against the chute during such travel. The spray head is connected to and is suspended from a flexible line 18 which herein is in the form of a hose. In addition to supporting the spray head, the hose 18 establishes communication between the head and a source (not shown) of sanitizing solution.

As shown in FIG. 1, the hose 18 extends vertically from the spray head 16 and then extends substantially horizontally through the chute 12 and the wall 14. Located outside of the wall and supported on the floor 15 is a rotatable reel 20 around which the hose is wound. The reel is supported by a bracket 21 to rotate about a horizontal axis and is connected by a belt 22 to a reversible motor 24. When the latter is energized, the hose is either played out from or wound up on the reel and causes the spray head 16 to travel downwardly or upwardly within the chute 12. The hose communicates with the source of sanitizing solution by way of a suitable rotary coupling (not shown) connected to the reel.

It is necessary to guide and support the hose 18 to travel horizontally through the wall 14 and then to travel vertically within the chute 12 without kinking or placing a sharp bend in the hose. In accordance with the present invention, the hose is supported and guided by unique apparatus 10 which may be installed quickly and easily in the chute 12 by forming a simple hole 25 in the wall and the chute and without need of cutting away large portions of the wall and the chute to gain access to the interior of the chute. The apparatus 10 is particularly characterized by the novel use of a length of roller chain 26 which serves the same general purpose as a pulley while being insertable through the wall and into the chute through the relatively small hole 25.

More specifically, the roller chain 26 herein is attached to the inner end of a guide in the form of a cylindrical tube 27 adapted to be inserted horizontally any endwise into the hole 25. The tube has an outside diameter which is approximately the same as the diameter of the hole and has an inside diameter substantially larger the the outside diameter of the hose 18. The inner end of the tube projects well into the chute 12 but stops short of the vertical centerline of the chute.

Attached to the outer end portion of the tube 27 by a set screw 28 (FIG. 4) is a collar 30 which may be received in a counterbore 31 in the wall 14. Both the hole 25 and the counterbore 31 may be formed by simple hole cutting saws and, as an alternative to forming the counterbore, the collar 30 may be telescoped into the tube 27 rather than being telescoped over the tube.

A flange 33 is formed integrally with the outer side of the collar 30 and lies against the wall 14 to cover the counterbore 31. Suitable screws 34 extend through the flange and are threaded into the wall to hold the tube 27 in place.

To guide the hose 18 into the outer end of the tube 27, angularly spaced rollers 35 are secured to the outer side of the flange 33. In the present instance, four rollers are employed with two rollers being rotatable about vertical axes and with the other two rollers being rotatable about horizontal axes. The rollers 35 are mounted on pins 36 (FIG. 3) which are supported by L-shaped brackets 37 on the flange 33. The rollers hold the hose 18 out of sliding contact with the bottom of the tube 27 and serve to guide the hose as the latter is played out from and wound up on the reel 20.

Figure 3:
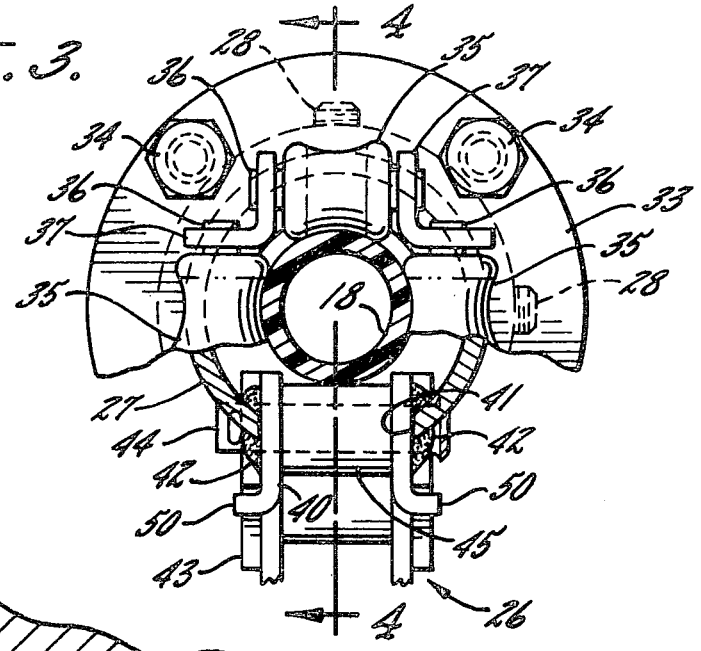
FIG. 3 is an enlarged view taken substantially along the line 3—3 of FIG. 1, parts of the apparatus being broken away and shown in cross-section.
Figure 4:
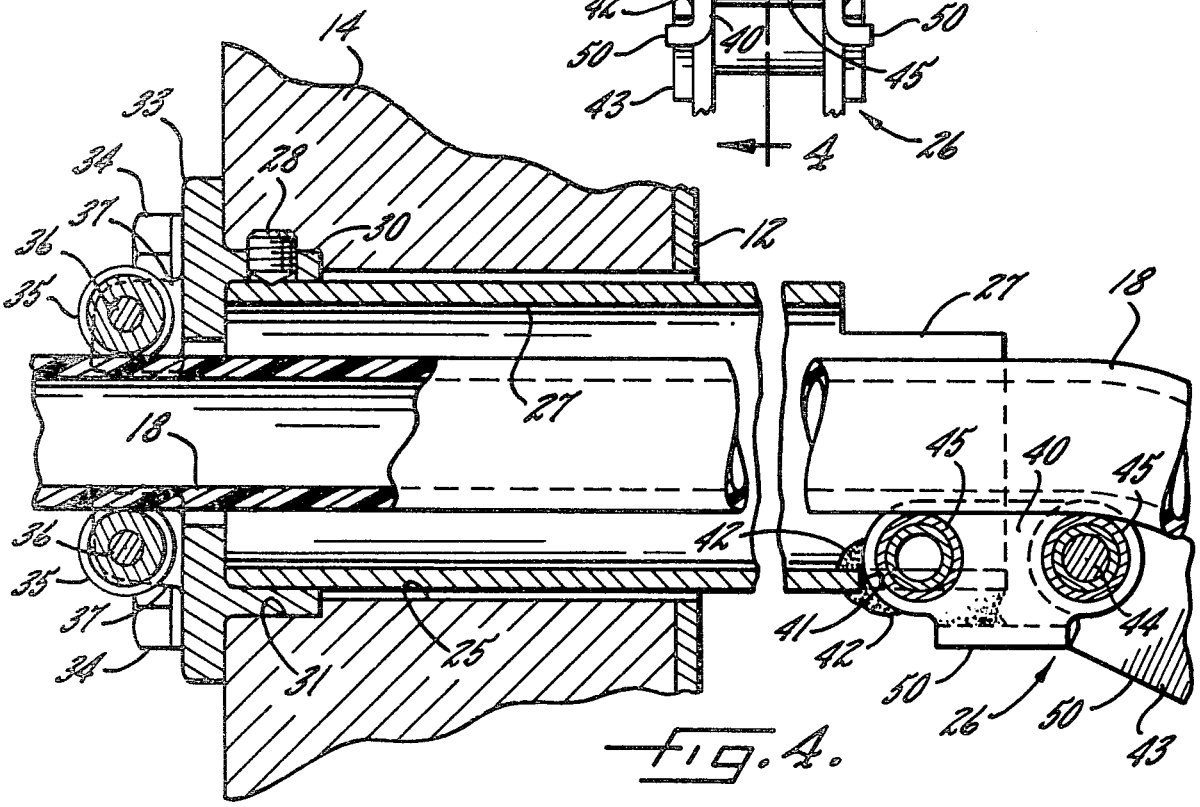
FIG. 4 is a fragmentary cross-section taken substantially along the line 4—4 of FIG. 3.

In carrying out the invention, the roller chain 26 is attached to the inner end of the tube 27 and is arranged to droop downwardly with a gradual downwardly concave curvature. As shown in FIGS. 3 and 4, the innermost link 40 of the chain is fitted within a notch 41 formed in the lower side of the tube 27 at the inner end thereof and is welded rigidly to the tube as indicated at 42. The remaining links 43 (there herein being four such links) are pivotally connected to the inner link 40 and to one another by horizontal pivot pins 44 which extend transversely of the hose 18. Rollers 45 are rotatably supported on each of the pins 44 and also on the inner end portion of the inner link 40 and serve as low friction supports for the hose.

Figure 2:
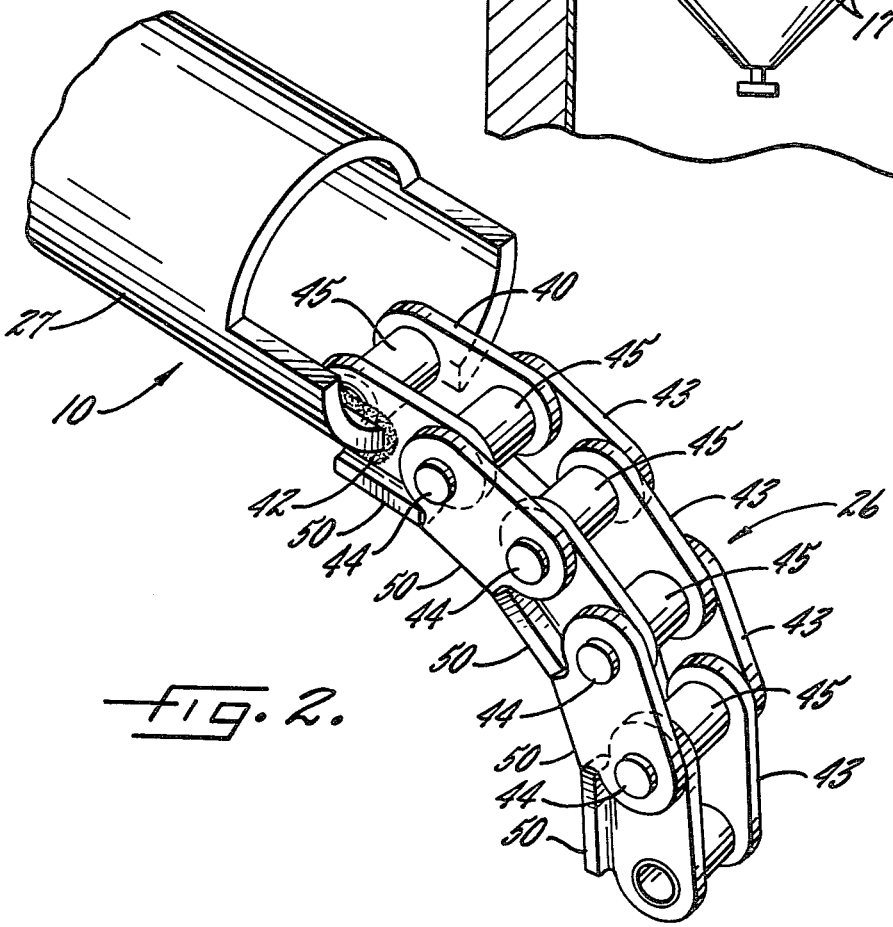
FIG. 2 is an enlarged fragmentary perspective view of the line supporting and guiding apparatus shown in FIG. 1.

Importantly, means are provided for limiting downward pivoting of the links 43 about the pins 44 thereby to cause the chain 26 to automatically assume a downwardly concave curvature rather than simply hanging straight downwardly from the tube 27. In the present instance, these means are defined by abutments or flanges 50 (FIG. 2) which are formed integrally with the lower sides of the links 40 and 43. When the tube 27 is positioned as shown in FIGS. 2 and 4, the flanges 50 on the innermost pivoted link 43 are disposed in end-to-end engagement with the flanges 50 of the fixed link 40 and, in addition, the flanges 50 of each pivoted link are disposed in end-to-end engagement with the flanges of each adjacent pivoted link. Such engagement limits downward pivoting of the links and holds the three innermost pivoted links out of vertical positions. The outermost pivoted link assumes a substantially vertical position as shown in FIG. 1 and, if desired, additional links may be pivotally connected to that link.

From the foregoing, it will be apparent that the chain 26 serves to guide the hose 18 for gradual transition from horizontal to vertical so as to avoid kinking of the hose as it moves up and down in the chute 12. In addition, the chain coacts with the rollers 35 to form a low friction support for the hose.

Figure 5:
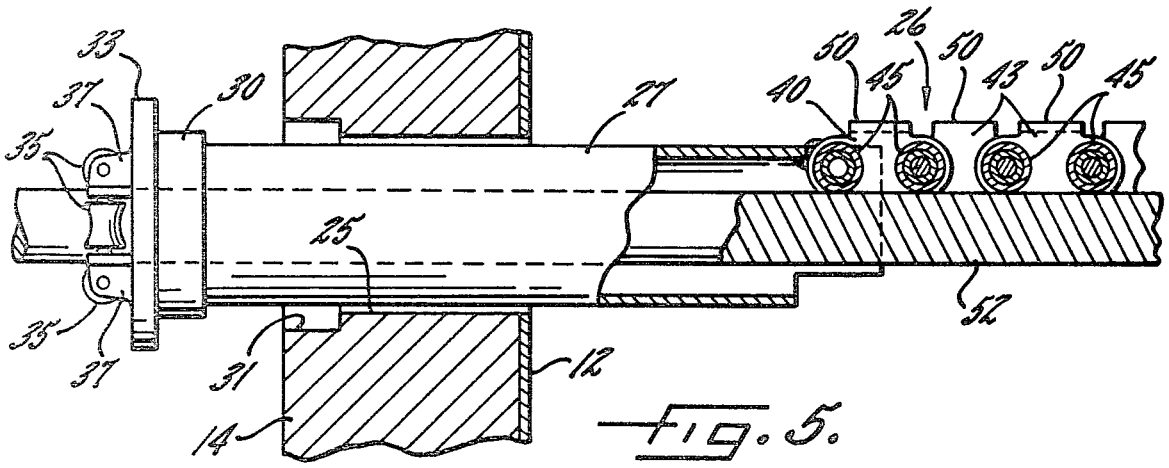
FIG. 5 is a view generally similar to FIG. 4 but shows the apparatus being installed in the wall and the chute.

Installation of the apparatus 10 may be effect simply by forming the hole 25 and the counterbore 31, by inserting the chain 26 and the tube 27 endwise through the hole and into the chute 12 and by securing the screws 34. To facilitate insertion of the chain through the hole 25, the tube 27 may be turned upside down as shown in FIG. 5 and a rigid rod 52 may be inserted into the tube and beneath the chain before the chain and the tube are moved through the hole. The rod stiffens the chain and enables the chain to be threaded easily through the hole without drooping and snagging on the wall or the chute. Once the chain has been inserted into the chute, the tube 27 can be rotated to its normal position (FIG. 4) and the rod 52 can be removed. The hose 18 then can be threaded through the tube and lowered to the lowermost floor for installation of the spray head 11.

Thus, the present invention brings to the art new and improved line supporting and guiding apparatus 10 which serves the same general purpose as a pulley but which can be installed much more easily in areas of limited access. While the apparatus has been specifically disclosed as supporting and guiding a hose, it will be appreciated that the apparatus can be used with other flexible lines such as cable, electrical wires and the like.

I claim:

1. Apparatus for supporting and guiding a flexible line for movement along a path having a substantially straight portion and having a downwardly concave portion located at one end of said straight portion, said apparatus comprising a guide having means for supporting said line for movement along said straight portion, and a length of roller chain attached to and projecting from one end of said guide, said chain having pairs of links pivotally interconnected to one another by generally horizontal pivots extending transversely of said path and between said pairs of links, said chain further including rollers rotatably supported by said pivots and disposed within said links, so that the longitudinal axes of said rollers coincide with the longitudinal axes of said pivots, the surface of said rollers being recessed below the edges of said links, and adapted to support said line, and means on said links for limiting downward pivoting of said links about said pivots and for causing said chain to project from said guide and assume a downwardly concave curvature.

2. Apparatus for supporting and guiding a flexible line for movement along a path which includes a substantially horizontal portion and a substantially vertical portion extending downwardly from said horizontal portion, said path further including a downwardly concave portion located between said horizontal and vertical portions, said apparatus comprising a substantially horizontal guide having means for supporting said line for movement along the horizontal portion of said path, and a length of roller chain attached to and projecting from one end of said guide, said chain having pairs of links pivotally interconnected to one another by generally horizontal pivots extending transversely of said path and between said pairs of links, said chain further including rollers rotatably supported by said pivots and disposed within said links, so that the longitudinal axes of said rollers coincide with the longitudinal axes of said pivots, the surface of said rollers being recessed below the edges of said links, and adapted to support said line, and means on said links for limiting downward pivoting of said links about said pivots and for causing said chain to hang downwardly from said guide with a downwardly concave curvature.

3. Apparatus as defined in claim 2 in which said guide comprises a generally cylindrical tube, said chain being attached to and projecting from one end of said tube.

4. Apparatus as defined in claim 3 in which said supporting means comprise at least one roller rotatably supported on the opposite end of said tube.

5. Apparatus as defined in claim 3 in which said supporting means comprise a series of rollers spaced angularly around and rotatably supported on the opposite end of said tube.

6. Apparatus as defined in claim 2 in which the uppermost link of said chain is attached rigidly to said one end of said guide, said limiting means comprising flanges on the lower sides of said links and engageable end-to-end with one another to restrict downward pivoting of said links.

7. Apparatus for supporting and guiding a flexible line, said apparatus comprising a generally horizontal and generally cylindrical tube of sufficient diameter to receive said line, roller means on one end portion of said tube for guiding said line into and out of said one end portion and for holding said line out of engagement with the lower interior wall of said tube, a length of roller chain projecting from the other end portion of said tube, said chain having one pair of links attached rigidly to and projecting generally horizontally from said other end portion of said tube, said chain further including a series of pairs of pivoted links pivotally connected to said one pair of links and pivotally connected to one another by generally horizontal pivots extending transversely of said line and between said pairs of links, said chain further including rollers rotatably supported by said pivots and disposed within said links, so that the longitudinal axes of said rollers coincide with longitudinal axes of said pivots, the surface of said rollers being recessed below the edges of said links, and adapted to support said line, and abutments on the lower sides of said links and engagable end-to-end with one another to limit downward pivoting of said pivoted links about said pivots and to cause said chain to project from said tube and assume a downwardly concave curvature.

8. Apparatus for supporting and guiding a flexible line for up and down movement in a vertical chute located inside a wall, said line extending horizontally through a hole in said chute and said well adjacent the upper end of the chute and being connected to means outside of said wall for moving said line upwardly and downwardly in said chute, said apparatus comprising a generally horizontal and generally cylindrical tube disposed within said hole, said tube having an inner end portion projecting into said chute and having an outer end portion located adjacent the outer end of said hole, roller means on the outer end portion of said tube for guiding said line into and out of said outer end portion and for holding said line out of engagement with the lower interior of said tube, a length of roller chain projecting from the inner end portion of said tube and depending into said chute, said chain having one pair of links attached rigidly to and projecting generally horizontally from said inner end portion of said tube, said chain further including a series of pivoted pairs of links pivotally connected to said one pair of links and pivotally connected to one another by generally horizontal pivots extending transversely of said line and between said pairs of links, having rollers rotatably supported by said pivots and disposed within said links so that the longitudinal axes of said rollers coincide with the longitudinal axes of said pivots, the surface of said rollers being recessed below the edges of said pairs of links, and adapted to support said line, and abutments on the lower sides of said links and engageable end-to-end with one another to limit downward pivoting of said pivoted links about said pivots and to cause said chain to project from said tube and to depend into said chute with a downwardly concave curvature, thereby directing said line to a vertical position within said vertical chute.

* * * * *